US008978579B2

(12) United States Patent
Dominguis Perez et al.

(10) Patent No.: US 8,978,579 B2
(45) Date of Patent: Mar. 17, 2015

(54) METHOD AND DEVICE FOR REGENERATING THE INTERIOR SURFACES OF CONDUITS BY MEANS OF THERMAL SPRAYING OF METALS

(75) Inventors: Héctor Dominguis Perez, Valencia (ES); Fernando Lazaro Terron, Valencia (ES); Marcelo Soto Tomas, Valencia (ES); Juan Ferre Prieto, Valencia (ES)

(73) Assignee: Ingeníera y Marketing, S.A., Valencia (ES)

( * ) Notice: Subject to any disclaimer, the term of this patent is extended or adjusted under 35 U.S.C. 154(b) by 418 days.

(21) Appl. No.: 13/508,053

(22) PCT Filed: Nov. 4, 2009

(86) PCT No.: PCT/ES2009/070480

§ 371 (c)(1), (2), (4) Date: May 4, 2012

(87) PCT Pub. No.: WO2011/054977

PCT Pub. Date: May 12, 2011

(65) Prior Publication Data

US 2012/0213913 A1 Aug. 23, 2012

(51) Int. Cl.

| | |
|---|---|
| ***B05B 13/06*** | (2006.01) |
| ***B05B 3/00*** | (2006.01) |
| ***C23C 4/14*** | (2006.01) |
| ***B05B 7/20*** | (2006.01) |

(Continued)

(52) U.S. Cl.

CPC ... *C23C 4/14* (2013.01); *B05B 7/20* (2013.01); *B05B 13/06* (2013.01); *C23C 4/12* (2013.01); *C23C 4/16* (2013.01)

USPC ..... 118/317; 118/302; 118/306; 118/323; 239/130; 239/172; 239/176

(58) Field of Classification Search

CPC ..... B05B 13/06

USPC ..... 118/306, 317, 303, 326, 712, 713, 302, 118/321, 323; 239/130, 172, 176, 752, 753, 239/433, 434, 670; 427/236, 239; 73/865.8

See application file for complete search history.

(56) References Cited

U.S. PATENT DOCUMENTS

| | | | |
|---|---|---|---|
| 2,865,321 | A | 12/1958 | Von Arx |
| 6,508,413 | B2 | 1/2003 | Bauer et al. |

(Continued)

FOREIGN PATENT DOCUMENTS

| | | | |
|---|---|---|---|
| DE | 3301548 | A1 | 7/1984 |
| GB | 2150050 | A | 6/1985 |

(Continued)

*Primary Examiner* — Yewebdar Tadesse

(74) *Attorney, Agent, or Firm* — Richard M. Goldberg

(57) ABSTRACT

A method for regeneration of internal conduit surfaces by thermal projection of metals, includes inserting a device including a vehicle having a rolling assembly to permit rolling of the vehicle and carrying a thermal projection system, through a manhole in a conduit installation, including the steps of inserting the device in a conduit with the rolling assembly in a retracted position, and expanding the rolling assembly inside the conduit until the device is centered in the conduit; inserting electrical, pneumatic and/or hydraulic conduits and conduits for supplying metal to be thermally projected, through the manhole, such that the conduits are connected with the vehicle; positioning a regeneration device including the thermal projection system connected with the vehicle by a remote-control pulling system in a particular position to be regenerated; thermally projecting metal from the regeneration device; advancing the vehicle and connected regeneration device to a new regeneration position.

11 Claims, 3 Drawing Sheets

(51) Int. Cl.
*C23C 4/12* (2006.01)
*C23C 4/16* (2006.01)

(56) References Cited

U.S. PATENT DOCUMENTS 7,181,985 B2 * 2/2007 MacMillan et al. ..... 73/865.8
2003/0161946 A1 * 8/2003 Moore et al. ..... 427/236
2011/0097486 A1 * 4/2011 Weisenberg ..... 427/236

FOREIGN PATENT DOCUMENTS

JP 7223073 A1 8/1995
JP 2003013197 A 1/2003
WO 01/69133 A1 9/2001

* cited by examiner

Fig. 3
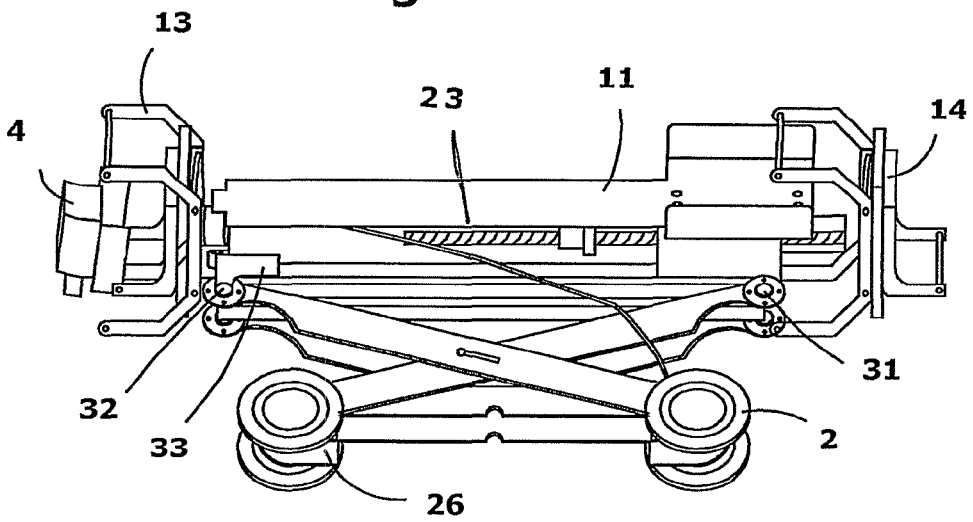
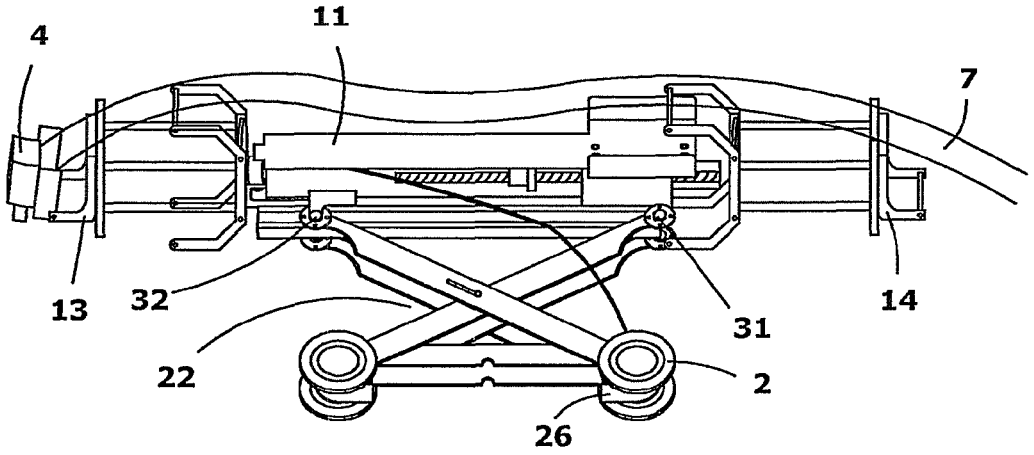
Fig. 4

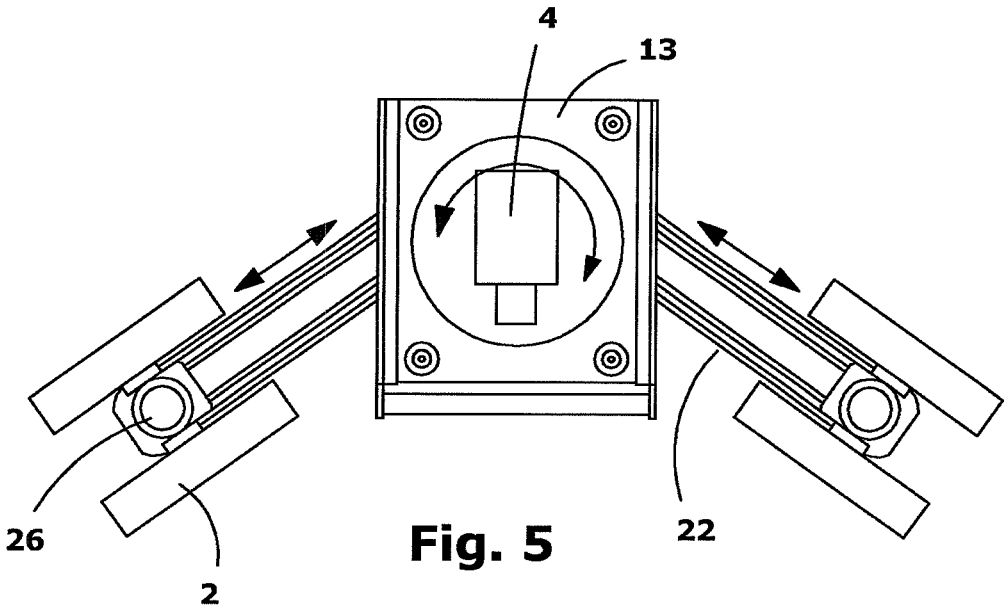
Fig. 5
Fig. 6
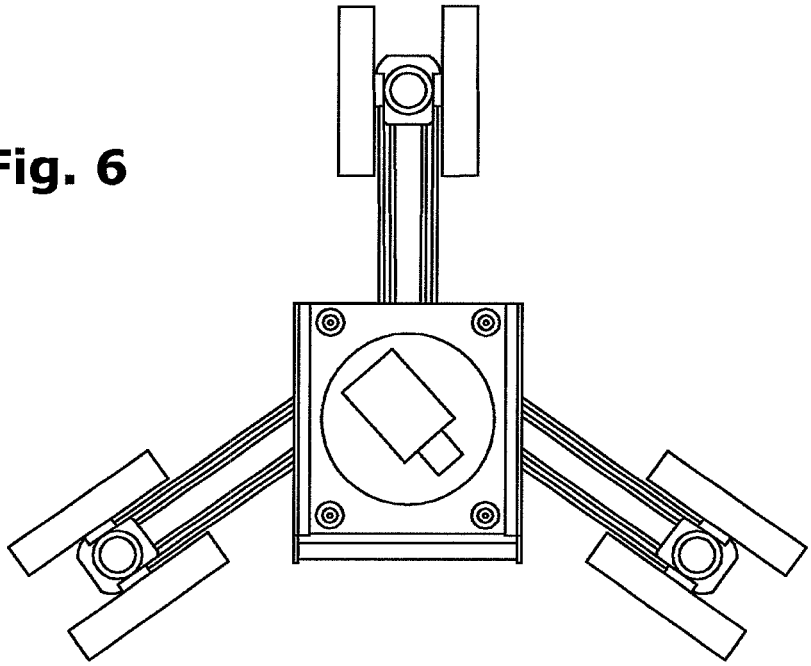

METHOD AND DEVICE FOR REGENERATING THE INTERIOR SURFACES OF CONDUITS BY MEANS OF THERMAL SPRAYING OF METALS

This invention covers a method for treating inner surfaces of conduits, such as conduits of vapour conduction installations, for example, in installations for electric energy production; according to said method a thermal projection device is deployed, through the end or a manhole of a conduit, and it comprises the operations of positioning, centering, possibly verifying the result, and advancing. It also comprises using mechanical, optical, acoustic or electronic means for recognition of any changes in direction of the conduit, and repositioning of the device in respect of said changes in direction.

This invention also comprises a device for treatment of inner surfaces of conduits which comprises a thermal projection device, pulling means, possibly means for centering a head for projecting particles of molten metal, pulling means and possibly a system for detecting any changes in direction of the conduit. The device also comprises means for supplying energy and feeding the metal to be projected.

Vapour conduits of all kinds of industrial installations, such as vapour conduits of energy production installations, are subject to aggression through abrasion, due to the high speed at which the vapour circulates, and this can be worsened by possible chemical aggression due to the ionisation of the vapour. Over time the abrasion becomes serious and can weaken the conduits. On one hand, these installations are extraordinarily costly, for which reason the replacement of material which can be preserved must be avoided, insofar as this is possible, and on the other, the use of a vapour installation in unsafe conditions proves highly dangerous, since any pore produced in the conduits, apart from a high risk for the safety of any operator who might be affected by the blast given off, would require immediate stoppage of the installation, replacement of the damaged section, and thorough revision of the entire installation, which would entail very high costs. Since there is wear, there has to be a replacement of the material dragged off by the vapour, so as to maintain the initial conditions, or at least safe conditions.

STATE OF THE ART

U.S. Pat. No. 6,508,413 describes a machine for cleaning and remote coating of a conduit, such as a vapour conduit. This machine comprises a support bar, fitted with associated motors, which comprises motors for the movement of a head along said bar, and for the rotation of the head, said head comprising means for abrasion cleaning and/or thermal projection of metal. It comprises at least one pair of tripods for proper positioning and securing in the pipeline and also comprises a device for control of the device. This device must work in sections, since the device must be repositioned in each of said sections, at the same time as there are zones, such as the zones for support of the tripod legs, which could lead to shortcomings in the coating, and would in any event require the reduction of the distances in which the devices has to be relocated in each new section.

SUMMARY OF THE INVENTION

This invention refers to a mobile device able to move along a conduit, particularly a horizontal conduit or one with a small slope, which comprises:

- A moving support; the moving support will be provided with at least one movement motor and possibly a motor on each of the sides;
- A set of means for pulling said moving support along the surface of the conduit; these pulling means can be wheels, chains or pulling bands;
  - The pulling means are possibly located more or less radially on the centre of the device, and preferably said pulling means are radially extendible for a proper adjustment on the section of the conduit;
- An operating head set in the front part of the moving support;
  - The operating head is preferably rotary, normally in a 360° arch or a little more, said rotation being limited by the cables and conduits that the device must hold;
- A device for thermal projection of particles of molten metal; the thermal projection device is set in the operating head; in turn the thermal projection device can be articulated on the operating head on an axis transversal to that of the conduit;
- At least one means of power supply; the power used can be electric energy, the power supply means consisting in a cable or set of cables inserted in the conduits through the manhole or open end of the conduit, as far as the regeneration device, hydraulic energy and/or pneumatic energy, in these last two cases the corresponding conduits or flexible hoses would be used;
- A means of supplying the metal to be projected, in the form of wire or wire coils;
- And possibly:
  - A device for detecting the state of the regenerated surface, understanding state to mean the degree of quality of the coated surface;
  - A display means;

BRIEF DESCRIPTION OF THE FIGURES

In order to illustrate the following explanation, we are enclosing with this descriptive report three sheets of drawings in which the essence of this invention is represented in six figures, and in which:

FIG. 3 shows a lateral schematic view of a second option of the device according to the invention, in which the body of the device comprises two angularly separated sets of wheel, is expandable and extendible to match the conditions of the conduit, in a retracted position;

FIG. 4 shows a lateral schematic view similar to the one in FIG. 3, but in an expanded and extended position;

FIG. 5 shows a front view of the device of FIGS. 3 and 4, in which one can clearly appreciate the angular separation of the wheels; and FIG. 6 shows a view like the one in FIG. 5, in which the device is fitted with three sets of wheels.

DETAILED DESCRIPTION OF THE PREFERENTIAL FORMS OF EMBODIMENT

Figure 1:
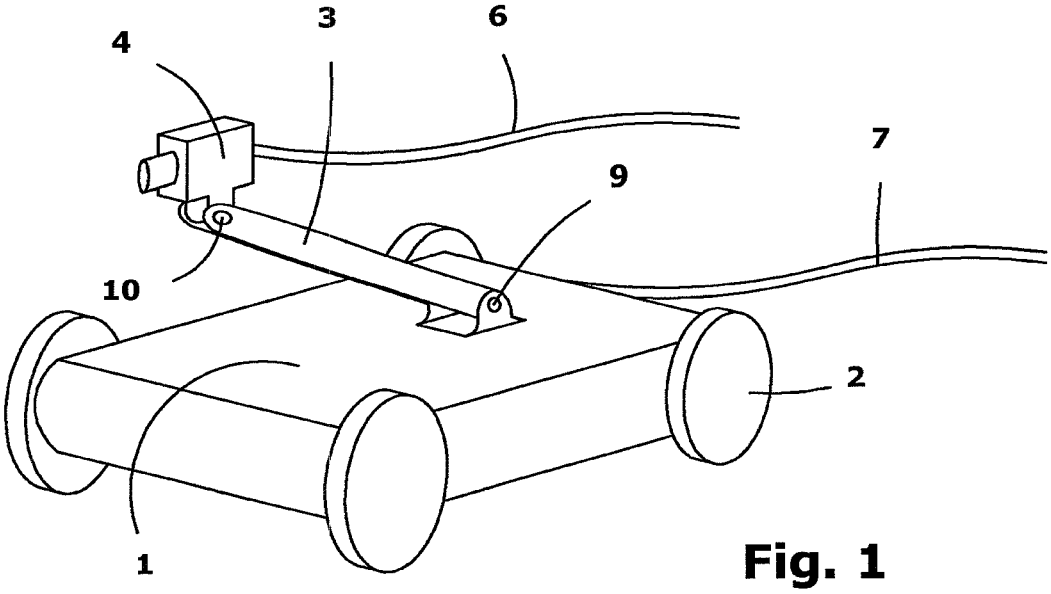
FIG. 1 shows a schematic view in perspective of a first more simple option of the device for regeneration of inner surfaces of conduits by means of thermal projection of metals according to the invention and FIG. 2 shows a lateral view of the device of FIG. 1.
Figure 2:
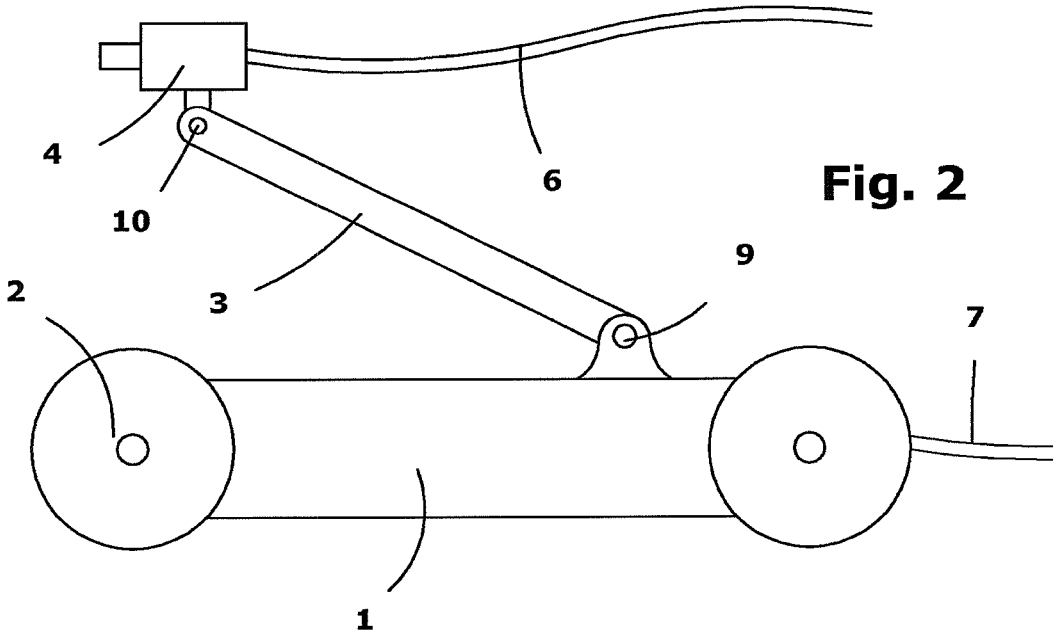

This invention therefore consists of a method for regenerating inner surfaces of conduits by means of thermal projection of metals, comprising the stages of:

Inserting a device carrying the thermal projection means through a manhole in a conduit installation; if the carrying device is expandable, the insertion will be performed with the device retracted;

Inserting electrical, pneumatic and/or hydraulic conduits through a manhole, as well as feeding the metal to be thermally projected;

Preferably, when the device is ready for this, the expansion of the rolling means to make sure that the device matches the conduit properly; it should normally be ensured that the device is centred in the conduit;

When the device is extendible, the extension of a support of a thermal projection device;

Movement of the device by remote-control pulling in a particular position to regenerate until this is positioned in the place to be regenerated, including, where applicable, the corresponding fixing;

The angle alignment of an operating head placed on the carrying device;

The thermal projection of metal from the regeneration device;

Rotation along the surrounding annular perimeter, normally approximately 360°, until proper regeneration is achieved, and advancing to a new regeneration position.

The method also optionally comprises picking up an image of the inside of the conduit and transmitting the information to a device for recording, viewing or information processing, located on the outside, from which the right decision can be made, such as for a further movement of the carrying device to regenerate a new zone, extraction of the device, or continuation of the projection process if the regeneration has not reached a satisfactory degree.

The method is also designed to include, as well as or instead of picking up the graphic image, measuring the thickness of the walls of the conduit or measuring prior to or after the thermal projection phase, determining in either of these cases if the operation has given a sufficiently satisfactory result.

This invention also covers a device for regenerating inner surfaces of conduits by the thermal projection of metals, as claimed in claim 4, which is formed of:

A remote-control vehicle (1), carrying a device for the thermal projection of metals (4), able to be inserted through a manhole for an installation of conduits such as an installation for energy generation; this vehicle (1) comprises, in a preferential embodiment, an elongated structure (11) carrying pulling means and a system for carrying a device for thermal projection of metal; the vehicle (1) is fitted with a set of wheels or pulling chains (2); according to the preferential embodiment, the vehicle (1) comprises at least two trains of wheels (22) angularly separated by roughly 120°±40°, fitted with at least one front wheel and at least one rear wheel, normally a pair of front wheels and a pair of rear wheels, at least on of the front or rear wheels or pairs of wheels is fitted with a drive motor; each front or rear wheel or pair of wheels will preferably be fitted with a motor with independent drive; optionally, though not preferably, three or more trains of wheels (22) will be fitted, separated from each other at a suitable angle; in the preferential option each of the trains of wheels is able to be expanded or retracted, so that the dimensions of the device are the very minimum for inserting into the conduit, to then have the proper operating dimensions inside the conduit;

An operating head (13) set on the vehicle, normally at the front (the opposite end to where the cables are connected) able to be positioned and angle-aligned properly in respect of said vehicle, comprising a device for thermal projection (4) of particles of molten metal; in accordance with a preferential option, the head (13) is extendible/retractile, for example by means of an endless screw (23), so that when it is in the operating phase the front end of this head will be at the furthest distance from the body of the vehicle (1); according to said preferential option; the operating head (13) is also able to rotate on a longitudinal axis; it is desirable for the rotation to take place at an angle close to 360°, so that in the thermal projection phase the regeneration takes place in the same way over the whole corresponding annular surface;

A device for thermal projection (4); this thermal projection device will normally be hinged on the operating head (13) on an axis transversal to that of the conduit;

Electrical (7), pneumatic and/or hydraulic connections for supplying, controlling and maneuvering the vehicle (1) and the head fitted with the thermal projection device (4) fitted on the remote-control vehicle (1);

A means of supplying the metal to be projected, in the form of wire or wire coils.

The rear end of the vehicle may possibly also comprise a securing device (14) for the cables, wire, or other conduits, and this securing device is preferably able to rotate in synchronisation with the operating head (13).

The device according to the invention is designed to also comprise a device for detecting the thickness and/or the surface evenness of the regenerated surface or also a device for picking up the image inside the conduit and transmitting the information to a device for recording, displaying or information processing.

In accordance with a preferential embodiment, the vehicle (1) comprises an hinged arm (3), one of whose ends is articulated to this vehicle (1) by means of a lower hinge pin (9) and the other in turn holds the operating head by means of an upper hinge pin (10). Preferably either the hinged arm (3), or the operating head or both of these comprise a rotation axle perpendicular to the corresponding hinge pin (9, 10) which enables the mobility of the head in the rotational direction (rotation in respect of a vertical axis when the operating head is set in a horizontal position).

The device disclosed in the invention comprises means of control for adjusting the position of the operating head.

In a preferential embodiment, the device for expanding/retracting the wheel trains (22) takes place by means of a fixed axle (31) (for each train) fitted in the elongated structure (11), as well as a corresponding mobile axle (32) able to be slid along by means of a track (33); as the axles approach each other, the angle of the corresponding carrying bars in respect of said elongated structure increases, causing the end where the corresponding wheels are located to move away.

What is claimed is:

1. A device for regenerating the inner surfaces of conduits by thermal projection of metals, comprising:

a remote-control vehicle having an elongate structure, said vehicle being insertable through a manhole of a conduit installation;

an operating head fitted on the vehicle, said operating head being positionable and angle-alignable properly in respect of said vehicle;

a thermal projection device mounted on said operating head for thermally projecting metals;

at least one of electrical, pneumatic and hydraulic connections for feeding, controlling and maneuvering the vehicle;

at least one of electrical, pneumatic and hydraulic connections for controlling and maneuvering the thermal projection device on the remote-control vehicle;

at least one of a set of wheels and pulling chains, separately controlled for moving the vehicle, and including at least two wheel trains angularly separated by approximately 90°±60°, fitted with at least one front wheel and at least one rear wheel, at least one of the wheels at the front or rear including a drive motor, and each of the wheel trains is expandable to an operating position in the conduit and retractable to a position for insertion/extraction in said conduit; and a device for expansion/retraction of each of the wheel trains and including a fixed axle set in the elongated structure, as well as a corresponding moving axle slidable along a track of the elongated structure.

2. A device for regenerating the inner surfaces of conduits by thermal projection of metals, according to claim 1, wherein the vehicle comprises three wheel trains separated from each other by an approximately equal angular distance.

3. A device for regenerating the inner surfaces of conduits by thermal projection of metals, according to claim 1, wherein the operating head on the vehicle is extendable in respect of a body of the vehicle, and rotatable a maximum angle of approximately 360°.

4. A device for regenerating the inner surfaces of conduits by thermal projection of metals, according to claim 3, further comprising a securing device at a rear of the vehicle for securing at least one of cables, wire and other conduits to the vehicle.

5. A device for regenerating the inner surfaces of conduits by thermal projection of metals, according to claim 4, wherein the securing device is rotatable in synchronisation with the operating head.

6. A device for regenerating the inner surfaces of conduits by thermal projection of metals, according to claim 1, further comprising a device on the vehicle for detecting at least one of thickness and surface regularity of the regenerated surface.

7. A device for regenerating the inner surfaces of conduits by thermal projection of metals, according to claim 1, further comprising a device for picking up an interior image of the conduit and transmitting the information to a device for at least one of recording, displaying and processing the information.

8. A device for regenerating the inner surfaces of conduits by thermal projection of metals, according to claim 1, further comprising a hinged arm, having one end hinged to said vehicle by a lower hinge pin and another end which holds the operating head by an upper hinge pin.

9. A device for regenerating the inner surfaces of conduits by thermal projection of metals, according to claim 8, wherein at least one of the hinged arm and the operating head comprises a rotation axis perpendicular to a corresponding said hinge pin.

10. A device for regenerating the inner surfaces of conduits by thermal projection of metals, according to claim 1, wherein the conduit installation is an installation for energy generation.

11. A device for regenerating the inner surfaces of conduits by thermal projection of metals, according to claim 1, wherein the at least two wheel trains are fitted with a pair of front wheels and a pair of rear wheels, at least one of the pairs of wheels at the front or rear including said drive motor.

* * * * *